United States Patent [19]

Sams

[11] 4,218,859

[45] Aug. 26, 1980

[54] WORKING BIN

[76] Inventor: Michael L. Sams, 1050 N. Grape St., Escondido, Calif. 92026

[21] Appl. No.: 908,281

[22] Filed: May 22, 1978

[51] Int. Cl.[2] ..... E04H 7/24

[52] U.S. Cl. ..... 52/194; 52/197; 52/263; 52/295; 52/743

[58] Field of Search ..... 52/194, 197, 263, 250, 52/295, 743

[56] References Cited

U.S. PATENT DOCUMENTS

| | | | |
|---|---|---|---|
| 704,805 | 7/1902 | Jamieson | 52/197 |
| 1,784,568 | 12/1930 | Bale | 52/295 |
| 3,038,566 | 6/1962 | Parsons | 52/194 |
| 3,311,333 | 3/1967 | Galloway | 52/295 |
| 3,327,870 | 6/1967 | Fairchild, Jr. | 52/197 |
| 3,382,633 | 5/1968 | Wilson et al. | 52/194 X |

FOREIGN PATENT DOCUMENTS

| | | | |
|---|---|---|---|
| 2145374 | 1/1973 | Fed. Rep. of Germany | 52/197 |
| 563144 | 8/1944 | United Kingdom | 52/197 |

*Primary Examiner*—Alfred C. Perham
*Attorney, Agent, or Firm*—Smyth, Pavitt, Siegemund, Jones & Martella

[57] ABSTRACT

A cluster of working bin modules resembling the cells of a honeycomb is used for storing tons of particulate commodities. This structure eliminates the need for corrugated sheet metal walls thereby reducing the explosion hazard. The bins share common smooth walls which are joined where they intersect by connectors which form hollow vertically-extending prisms. After the hexagonal modules have been erected and connected, the prisms are filled with concrete to form a watertight seal between adjacent bins and to permit the prisms to support heavy equipment mounted on top of the cluster. The hexagonal working bins are mounted on columns formed by concrete-filled vertical tubes. Each column is attached to the foundation by a ground anchor having a structure providing high shear strength to resist earthquake damage. Each column includes at its top a short hollow hexagonal prism; horizontal struts connect the hexagonal prisms of adjacent columns. The lower edges of the bin walls are welded to the tops of these struts. Hoppers welded to the struts form the bottoms of the bins. The individual hexagonal bins are built on the ground on their sides, and are thereafter hoisted above the ground in a horizontal attitude and while suspended in the air they are rotated to a vertical attitude and lowered into their positions on top of the columns.

24 Claims, 16 Drawing Figures

18
10
10
2
2
24
20
14
22
16
12

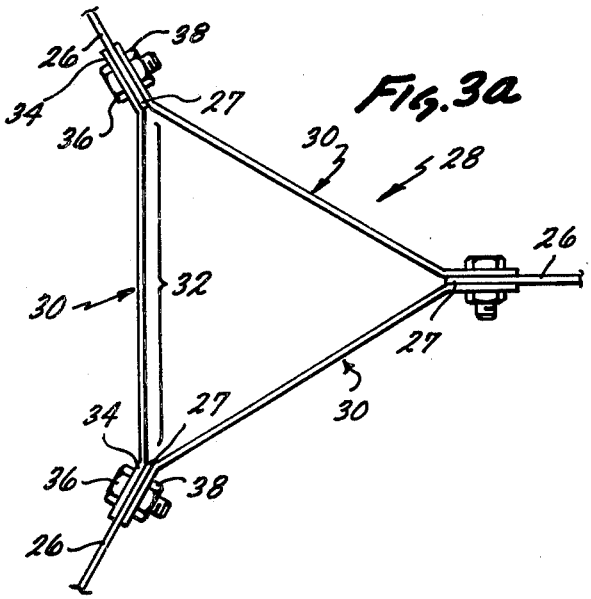
Fig. 3a
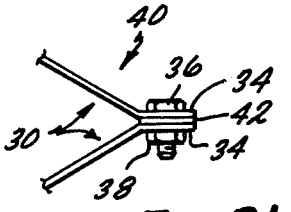
Fig. 3b
Fig. 4
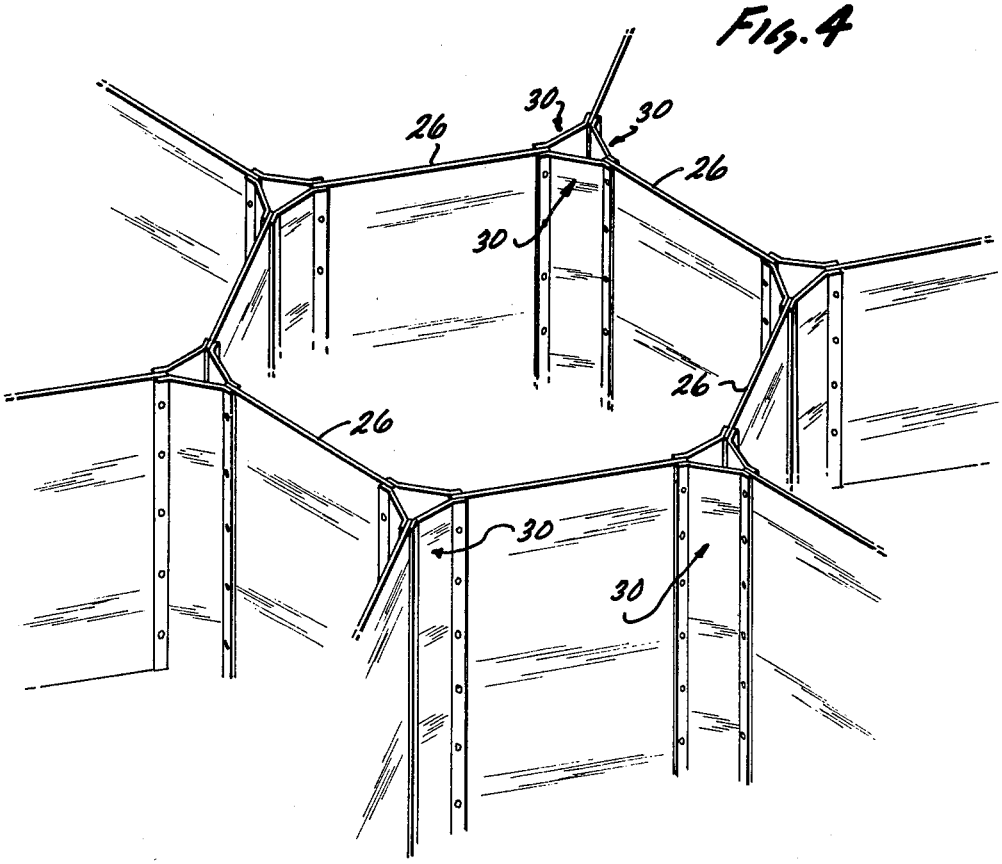

26
30
26
58
58
52
88
20
7
94
80
86
7
96
90
92
82
84
64
44
22
74
76
12
48
74
76
72
66
78

WORKING BIN

BACKGROUND OF THE INVENTION

1. Field of the Invention

The present invention is in the field of building structures and construction techniques and more specifically, relates to a structure used for storing commodities.

2. The Prior Art

The structure described herein can be used advantageously for storing a wide variety of particulate commodities including, but not limited to, grains, cement, crushed rock, pelletized materials and chemicals. The most likely application of the invention is for use as a chamber in which grain or feed can be stored.

For long-term storage, whole grain is typically stored in large tanks or silos having a capacity of 2,000 to 5,000 tons. This grain is eventually milled for use in making various mixtures of grains for use as feed. After some of the grain has been removed from the large tank, it is milled and then stored in a working bin, from which it is drawn as desired for mixing with other milled grains to produce a feed of desired proportions. The working bin typically holds 60 tons of ground or powdered commodity and includes means for delivering a metered amount to a weigh hopper. The present invention relates to a novel construction for working bins.

Wood and concrete are not desirable for use as working bins, although they were used in the past. Working bins of wood and concrete tend to absorb moisture and to transfer the moisture to the grain which generates a gas which can explode. Also, concrete and wood structures cannot get rid of static electricity as easily as metallic structures. For these reasons, most modern working bins are of metallic construction.

Grain stored in a working bin exerts considerable sideward force on the walls of the bin, tending to cause them to bulge out. For this reason, the walls are almost universally made of corrugated metal with the corrugations extending in a horizontal direction. Unfortunately, most types of stored material and particularly soy beans tend to hang up on the horizontal corrugations as the stored material is drawn from the working bin. Also, a dust of the stored material tends to collect on the corrugations above the stored material. In addition to presenting problems of cross-mixing when a different material is later stored in the same working bin and the practical difficulties in sweeping the dust from the corrugations in a 45-foot tall chamber, the tendency for the material to collect on the corrugations prevents a serious hazard.

It is well known that finely-divided substances tend to be more readily oxidized and some materials such as alfalfa dust or cornstarch are especially explosive. For all of the above reasons the use of horizontally extending corrugations is not desirable.

Most corrugated metal is manufactured in rolling mills and hence the width of the sheets supplied is limited by the width of the rolling mill. Consequently, when the corrugations are to be oriented horizontally, it is necessary to form a wall by joining a number of corrugated sheets. In one form of construction known in the art, the corrugated sheets are attached by bolting or welding to the metal frame of the structure. This technique has the disadvantage that most of the assembly is done in place, and there is no possibility of pre-assembling large modular sections on the ground. As a result, this type of prior art construction results in higher labor costs for a bin of given size.

In view of the aforementioned disadvantages of the prior art structures and construction techniques, it is apparent that a long-felt need exists in the industry for a working bin which can be constructed at minimum cost and which will have smooth interior walls to avoid the hazard associated with the corrugated walls conventionally used.

SUMMARY OF THE INVENTION

The present invention provides both a structure and a method for the construction of working bins which are both less expensive and less hazardous than those known to the prior art.

In accordance with the present invention, the working bins have a generally hexagonal cross section. Typically, two or more working bins are built adjoining one another in a honeycomb structure in which some of the walls are shared between two bins. It is a fact of geometry that a circle can enclose more area per unit of length than any other shape of curve. The hexagonal cross section used in the present invention approximates the ideal circular shape more nearly than does a square or rectangular shape, and compared with the square shape, the hexagonal shape uses less steel per ton of commodity stored.

Less apparent, but very important, is the fact that each of the walls of a hexagonal bin has less width than a wall of a square bin of the same cross-sectional area. Because the walls of the hexagonal bin used in the present invention are less wide, they are less easily bowed by the lateral pressure of the stored commodity. This permits the bin walls to be made of 10-gauge flat sheet steel in contrast to the corrugated steel required in prior art structures to withstand the pressure.

The elimination of corrugated bin walls is a major step forward in preventing explosions and increasing flowability of the commodity, as described above. Also, the flat sheet steel used in the bin walls of the present invention is easily handled and stacked. All of the bin walls for a multi-bin structure can be piled in a stack less than three inches deep for shipping or handling.

A particularly significant feature of the structure is the joint used for connecting the three walls which intersect at the corners of the bins. The bin walls, as seen in a horizontal cross section, are arranged in the form of a hexagon. However, each of the bin walls stops short of extending to the geometric corners of the hexagon.

Instead, each pair of adjacent bin sides is connected by a connector which cuts diagonally across the corner of the hexagon on the inside of the bin, so that in cross section, the bin looks like a hexagon with the corners cut off. Each connector is bent at its edges to lie flush against the edges of the two bin walls it joins and to which it is bolted.

When two or more of such hexagonal bins are formed into a honeycomb cluster, there will be some locations, at the ends of the common walls, where three walls are joined by three connectors. At such points, a hollow triangular prism is formed by the connectors which are oriented back-to-back. The sides of the bin extend outwardly from the corners of the vertically-extending triangular prism.

This structure of triangular cross section, of course, extends vertically forming a triangular prism. After the bins have been formed into a honeycomb structure and securely bolted together, the triangular prisms are filled with concrete which greatly enhances the rigidity and strength of the structure and which forms a water-tight seal between adjacent bins. It is not necessary to weld the bin walls to the connectors, and this results in a considerable saving in labor.

Because the working bins are used for delivering a metered quantity of milled commodity to a weigh hopper, provision must be made for discharging the commodity from the working bin. This is accomplished by providing a hopper assembly at the bottom of each working bin.

The hopper assembly includes a downwardly tapering transition cone leading downwardly from the lower edges of the bin walls to an opening at the bottom of the transition cone.

In a preferred embodiment, a negative-pressure cone is attached to the bottom of the hopper cone and extends downwardly below it flaring outwardly and downwardly. The purpose of this negative pressure cone is to relieve, at least partially, the compression of the commodity that is produced by the pressure of the overlying material. The negative pressure cone also serves as an adaptor for attaching the horizontally-extending feeder screw which draws the commodity from the bin. In a preferred embodiment, the negative pressure cone is rotatable about a vertical axis to permit rotation of the feeder screw to any desired angle.

To provide sufficient space between the ground and the hopper opening at the bottom of each bin, the bins are mounted on top of a number of columns. In a preferred embodiment, separate columns extend from the ground to a height of approximately 10 feet. The columns are pipes approximately one foot in diameter. The hollow pipes are strong enough to support the loaded bins, but in a preferred embodiment, the pipes are filled with concrete, which multiplies their load-bearing capacity by preventing them from buckling. This manner of forming the columns eliminates the need for reinforcing bars within the columns and eliminates the need for the forms normally used in casting concrete columns. Each column is attached at its lower end to a ground anchor.

The ground anchor comprises a steel assembly, including anchor bolts which is embedded in a concrete foundation. Four anchor bolts are arranged to extend into the foundation at the corners of a square. The four anchor bolts are held in this configuration by a square frame of angle iron which surrounds them, and is welded to them. Above the square frame, a separate square plate having a hole in each corner is slipped onto the anchor bolts from above, so that the bolts extend upward through the plate.

The square plate has a large square aperture centered on it, and from this aperture a steel box of square cross section extends down into the concrete within the square space defined by the anchor bolts. This steel box is surrounded inside and outside with concrete and the concrete extends upward from the inside of the box to the inside of the column. This feature provides much greater shear strength between the column and the ground enhancing the earthquake resistance of the structure, so that it can be used in areas designated in the Uniform Building Code as Seismic Zone Four.

A circular steel plate is welded to each column at its top end to close it. Then a hollow prism of hexagonal cross section and about 6 inches high is welded on top of the steel plate. Three of the vertical faces of the prism face toward the adjacent columns. These alternate faces of the prism are provided with clearance holes so that horizontally extending struts joining the adjacent prisms can be bolted to the faces of the prism.

In this manner, all pairs of adjacent columns are joined at their tops by horizontally extending struts. Additionally, as required to comply with local building codes and earthquake standards, adjacent columns around the periphery of the cluster are braced by cross braces extending diagonally from the top of one column to the bottom of an adjacent column.

The struts joining the columns at their tops resemble inverted troughs having a cross section in the shape of an inverted "V". The lower edges of the upwardly-extending bin walls are welded to the struts along the peak of the inverted V, and the cone-shaped hoppers that extend below the bins are welded to the sloping sides of the struts. Thus, the horizontally extending struts not only strengthen and stabilize the structure by interconnecting the columns, but additionally, the struts serve to connect the bin walls to the columns and the hoppers to the bin walls.

The method of forming the structure of the working bin is also believed to be novel. First the structure described above comprising the foundation, anchors, columns and struts is built on a prepared site. In a typical situation, a number of working bins are to be constructed in a honeycomb structure. From the plan view of the cluster it is possible to select a set of hexagonal bins which have no walls in common with the other members of the set. These bins are then constructed on the ground on their sides.

In succession, each of these bins is then hoisted at least 10 feet above the ground in a horizontal position by a crane, then rotated in the air to a vertical attitude and set down into its final position on top of the previously-erected structure of columns and struts. When all of the bins in the set have been hoisted into place, the remaining bins are formed by bolting together on the ground certain pairs of adjacent bin walls and then hoisting them into position and connecting them with the previously erected bins. When all possible pairs of adjacent bin walls have been thus installed, any remaining individual bin walls required to complete the cluster are set in place.

When the wall pairs and individual bin walls are set into position successively, workmen initially fasten the newly-added parts to the already-erected structure by first inserting bolts at the top and bottom of the added parts. Thereafter, a workman riding in a hoisted sling inserts the remaining bolts along the vertical edge of the newly-added part.

The bin walls are not welded along their vertical edges, but are welded along their bottom edge to the underlying strut. Even though the bin walls are not welded, a watertight joint is maintained between adjacent bins by filling the prism-like spaces between them with concrete, as described above.

This method of construction is significantly easier than that used in the prior art because it permits the modular bin cells to be assembled on the ground rather than on an elevated structure, and because it minimizes the amount of welding, particularly welding on elevated structures along the vertical edges of the walls. The working bins built in accordance with the present invention use a modular honeycomb structure. This shape is very economical in its use of steel, and, at the same time, results in a structure that is extremely strong and resistant to earthquakes. The inside of the bin walls is smooth rather than corrugated and this significantly reduces the danger of explosions caused by dust build-up. The novel joint used in the present invention for connecting the walls of the bins results in a watertight seal between adjacent bins without the need for welding the walls together along their vertical edges.

These and other novel features believed to be characteristic of the invention, both as to its structure and the method of forming it, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only, and are not intended as a definition of the limits of the invention.

BRIEF DESCRIPTION OF THE DRAWINGS

FIG. 3*a* is a fractional cross-sectional view looking down as in FIG. 2 and showing in greater detail the joint used in forming the structure of the working bin in a preferred embodiment of the present invention;

FIG. 3*b* is a fractional cross-sectional view similar to FIG. 3*a* but showing a fraction of a peripheral joint;

FIG. 4 is a diagram in perspective illustrating one of the generally hexagonal working bins according to a preferred embodiment of the present invention;

DESCRIPTION OF THE PREFERRED EMBODIMENT

Figure 1:
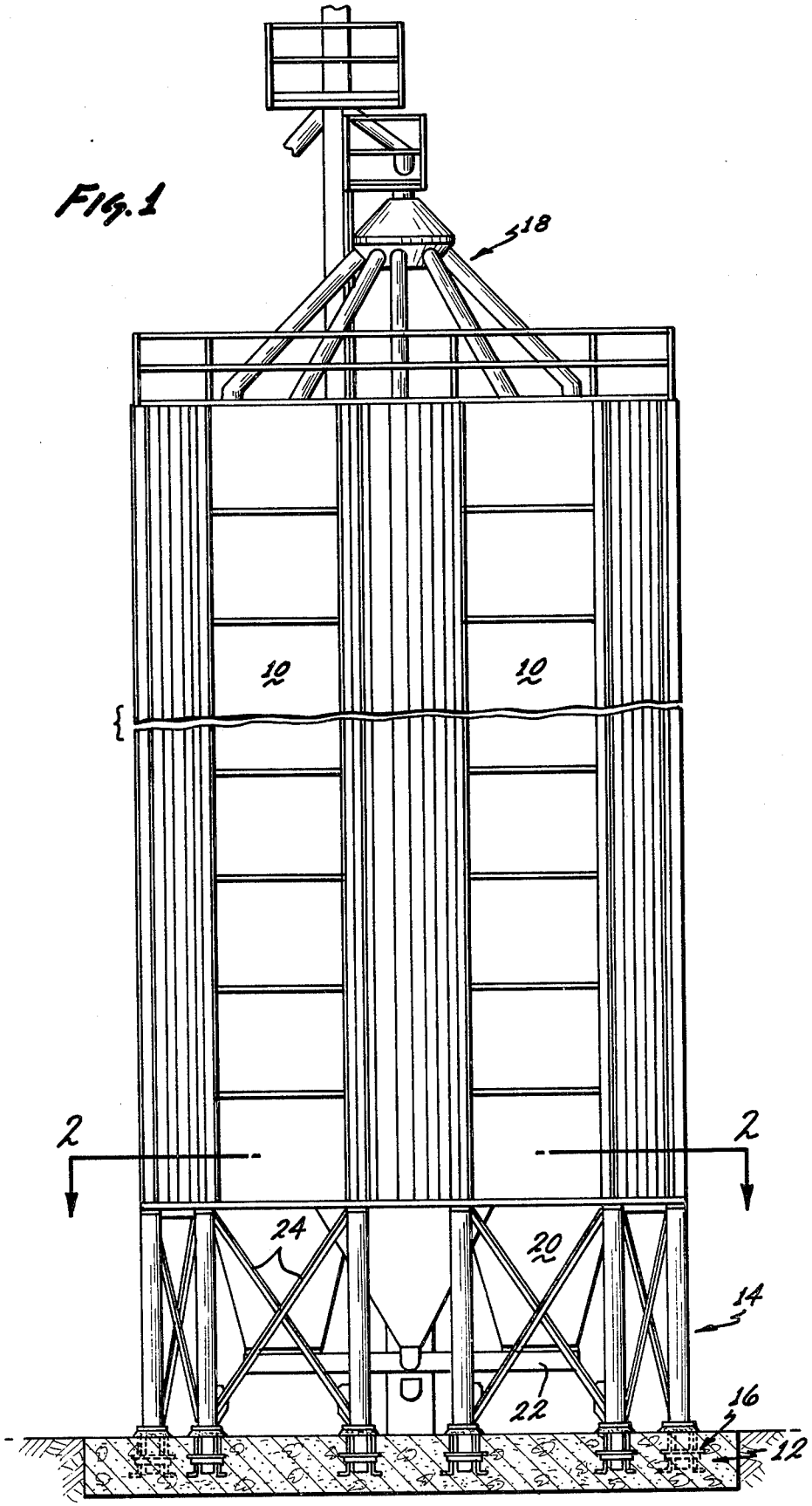
FIG. 1 is an end elevation view of the working bin of the present invention.
Figure 2:
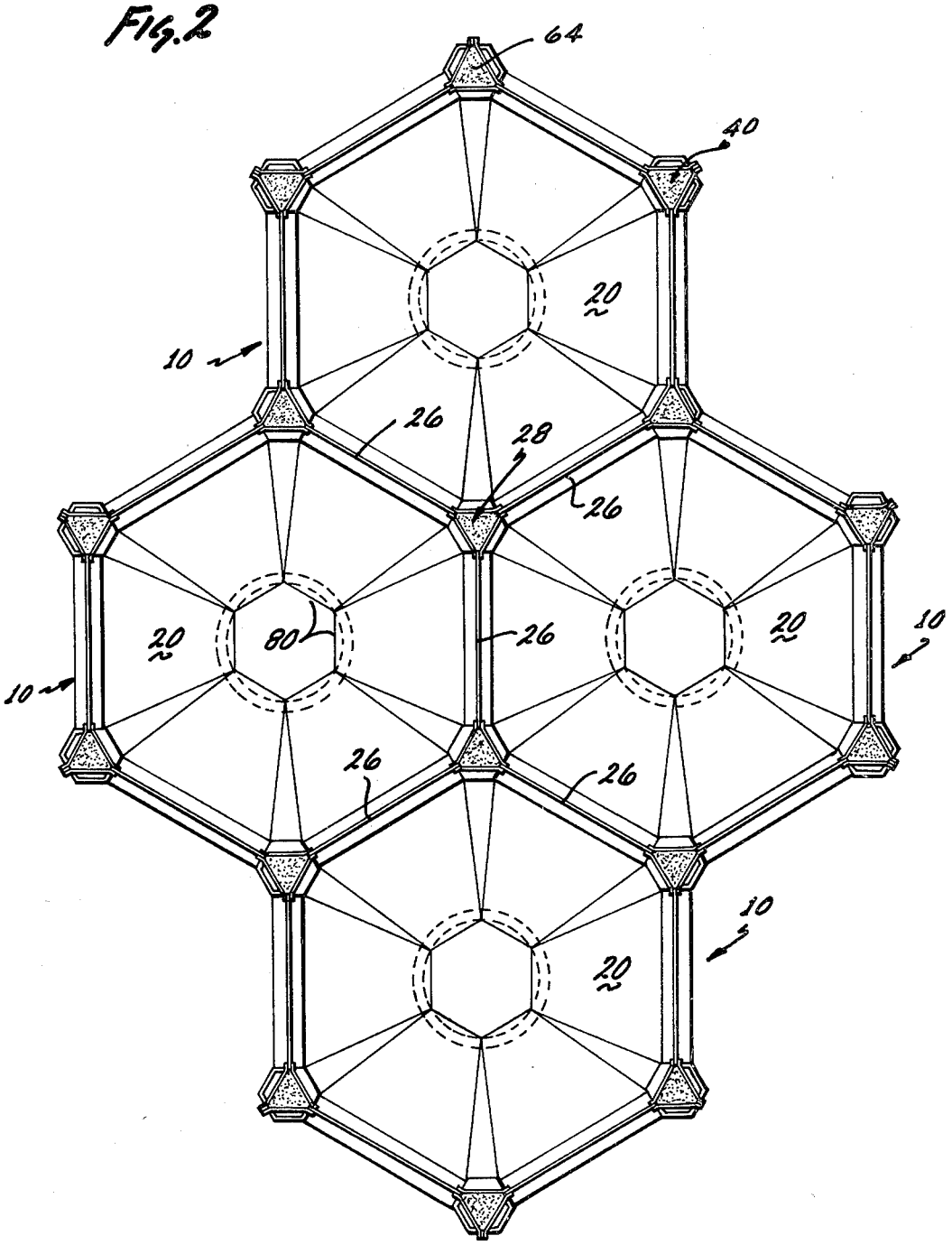
FIG. 2 is a cross-sectional view of the working bin of the present invention looking down in the direction 2—2 as indicated in FIG. 1.

Turning now to the drawings, in which like parts are denoted by the same reference numeral throughout, there is shown in FIGS. 1 and 2 a cluster of four working bins 10 constructed in accordance with a preferred embodiment of the present invention.

Figure 5:
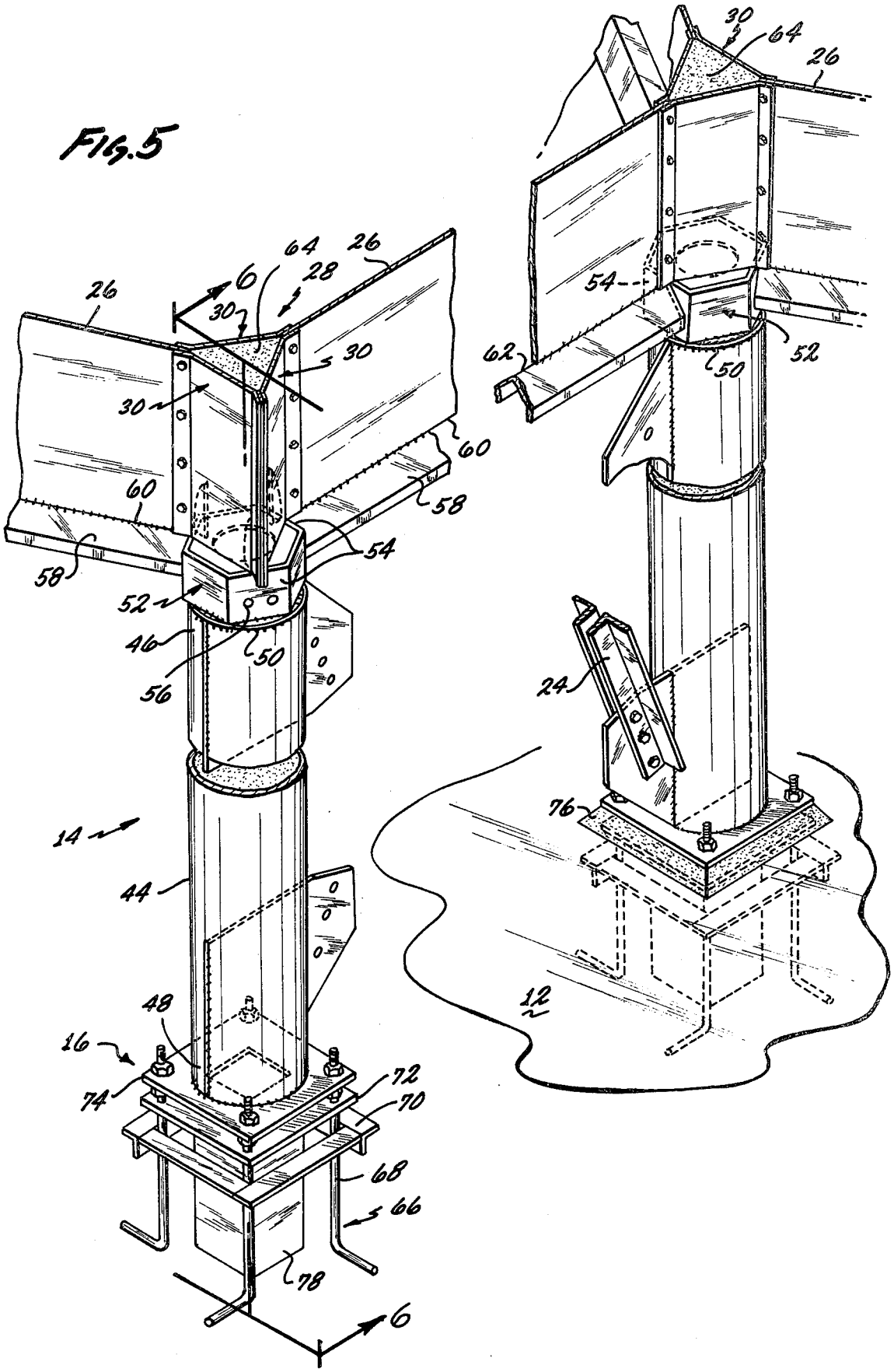
FIG. 5 is a fractional perspective view showing a portion of the structure of the working bin of FIGS. 1 and 2 and showing more clearly the structure of the pillars used to support the working bins according to a preferred embodiment of the present invention.
Figures 14, 15:
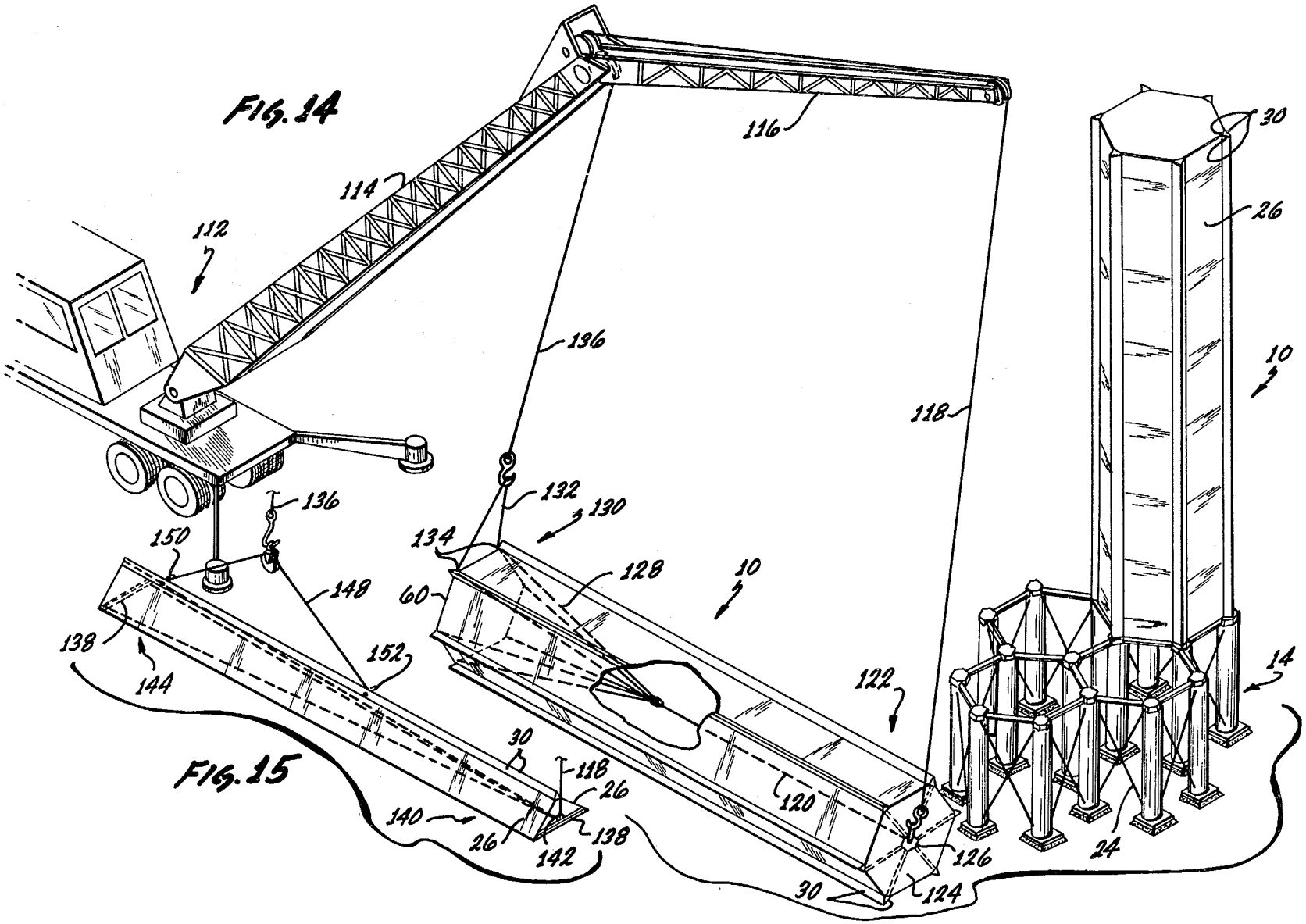
FIG. 14 is a perspective view showing the method of erecting the cluster of working bins on the site according to a preferred embodiment of the present invention; and, FIG. 15 is a fractional perspective view showing how the cables are rigged for hoisting a portion of the working bin in accordance with a preferred embodiment of the present invention.

Proceeding from the ground upwardly, the structure includes a foundation 12 which supports a system of pillars 14 which are attached to the foundation by ground anchors 16. The pillars 14 support the working bins 10, and in a typical installation, the pillars 14 are approximately ten feet high while the working bins extend 45 feet above the pillars. The material is fed into the working bins 10 by a distribution system 18, and the stored material is removed from the working bins 10 through hoppers 20 connected to the lower end of the working bins 10. A feeder screw 22 is selectively connected to one of the hoppers 20 to draw the stored material from it. As shown in FIGS. 1, 5, and 14, the pillars 14 are interconnected by diagonal cross braces 24, in a preferred embodiment, to enhance the rigidity of the pillar system.

According to a preferred embodiment of the present invention, the working bins 10 are arranged in a honeycomb structure as shown in FIG. 2. One advantage of this structure is that certain of the vertical walls, indicated by the numeral 26 are common walls serving to separate two of the working bins 10. Another advantage of this configuration is that the generally hexagonal cross-sectional shape of the working bins 10 approximates a circular cross-section and therefore approaches the ideal, maximizing the amount of volume that can be enclosed with a given amount of wall area. The honeycomb structure is also known to be a very strong structure, which is desirable in a working bin to resist both external forces as well as internal pressures.

Careful inspection of FIG. 2 will reveal that the cluster of working bins 10 embodies a modular concept of structure which permits additional working bins 10 to be added to the cluster with ease.

If each of the working bins 10 had a square cross-section instead of a hexagonal one, the width of the wall of the squares would be approximately twice the width of the walls of the hexagonal structure. This is an important factor in the design of the present invention. A wider wall has a greater tendency to bow when under internal pressure from the stored commodity than does the narrower wall used in the hexagonal structure. As a result, it is not necessary to corrugate the vertical walls of the working bins 10, and, therefore, the stored material and dust cannot hang up on the corrugations.

The modular structure of the working bins can be regarded alternatively as either a repeated pattern of generally hexagonal working bins 10, as illustrated in FIG. 4, or as a repeated pattern of joints of the type indicated by the reference numeral 28 of FIG. 2 and shown more clearly in FIG. 3*a*.

As shown in FIG. 3*a*, the vertical walls 26 which approach an intersection at the joint 28 terminate at vertical edges 27 short of their point of intersection. The vertical walls 26 are joined by the connectors 30 which are attached to the vertical walls 26 by the bolts 36 and nuts 38. Each of the connectors 30 includes a planar central panel 32 and a pair of side panels 34 on either side of the central panel. The side panels 34 are bent out of the plane of the central panel 32 so as to lie flush against the vertical walls 26. It should be noted that the side panels 34 are attached to the surfaces of the vertical walls 26 which face toward the interior of the hexagon enclosed by those surfaces.

FIG. 3*b* illustrates the joint used around the periphery of the cluster shown in FIG. 2 and denoted by the reference numeral 40 in FIG. 2. In such instances, a resilient strip 42 is sandwiched between the side panels 34 of the connectors 30 to form a watertight joint. If, at some later time, it is desired to add an additional bin, the resilient strip 42 may be replaced by a wall 26.

Referring back to FIG. 3*a*, the three connectors 30 at each joint define a triangular prism which extends vertically. In accordance with a preferred embodiment of the present invention, after the vertical walls 26 have been erected, the triangular prisms defined by the connectors 30 are filled with a castable material. The castable material is poured into the prisms in a fluid state and thereafter solidifies. In a preferred embodiment of the invention, the castable material is concrete, although in alternative embodiments other materials such as plastic or plastic foam are used. Filling the triangular prisms with a castable material not only enhances the rigidity of the structure, but it also forms a watertight seal between the working bins which protects the stored material both from atmospheric moisture and rain as well as cross-contamination and infestation by insects.

FIG. 4 shows in diagrammatic form a typical working bin formed in accordance with the preferred embodiment of the present invention. Each such working bin includes six vertical planar walls 26 connected by six connectors 30. Each of the six connectors is associated with a different adjacent pair of the six vertical walls. In a preferred embodiment of the present invention the six vertical walls and the six connectors are formed of sheet metal, for example, 10 gauge sheet stock.

In accordance with the preferred embodiment of the present invention the connectors 30 are attached to the walls 26 by the nuts and bolts 38, 36. It is recognized, however, that in alternative embodiments, other kinds of fasteners such as rivets or spot welds can be used.

FIG. 5 is a perspective view showing how the working bins 10 are mounted on top of the pillars 14 to the foundation 12. The pillars 14 include a hollow metal tube 44 which is filled with a castable material such as concrete after the tube 44 has been set into position. The filled tube constitutes a column which extends upwardly from the ground anchor to a top 46 from a lower end 48. The central axis of the tube 44 is vertical. The top 46 of the tube 44 is closed by welding a circular plate 50 to it. A cap 52 is positioned on top of the circular plate 50 and welded to it. In accordance with the preferred embodiment of the present invention, the cap 52 is a hollow structure. The caps on adjacent columns are oriented so that their vertical faces 54 are perpendicular to the vertical walls 26. These opposing faces 54 are provided with holes 56 which are used for bolting the struts 58 to the caps 52. After the struts 58 have been bolted to the caps 52, the vertical walls 26 of the working bins are hoisted into position with the joints 28 centered on the columns and with the lower edges 60 of the vertical walls 26 coinciding with the top 62 of the strut 58. Thereafter, the lower edge 60 is connected to the top 62 of the strut by welding. Finally, the triangular prism defined by the connectors 30 is filled with a castable material 64. This material 64 also fills the caps 52. Thus, each of the working bins 10 includes six of the struts 58 at the lower edges 60 of its vertical walls 26.

The ground anchor 16 includes four anchor bolts 66 having shanks 68 which extend vertically at the corners at the corners of a square. The anchor bolts 66 are held in this configuration by a square frame 70 of angle iron. A substantially horizontal plate 72 is positioned on the anchor bolts 66 and is substantially at the elevation of the top surface of the foundation. The lower end 48 of the tube 44 is welded to a plate 74 which has clearance holes to pass the threaded ends of the anchor bolts 66. The tubes 44 are rendered vertical by adjustment of the position of the plate 74 with respect to the anchor bolts 66. Likewise, the tops 46 of the tubes 44 are adjusted to lie in a common substantially horizontal plane by adjustment of the elevation of the plate 74 with respect to the anchor bolts 66. After these adjustments have been made, the space between the plates 72, 74 is filled with grout 76. The plate 72 is attached to a hollow box-like tube 78 which extends downwardly from the plate 72 into the space between the anchor bolts 66 to increase the shear strength of the attachment of the tubes 44 to the foundation, thereby providing greater resistance to earthquake damage. The box-like tube 78 is filled with a castable material such as concrete. The structure of the ground anchor is also seen in FIG. 6.

Figure 6:
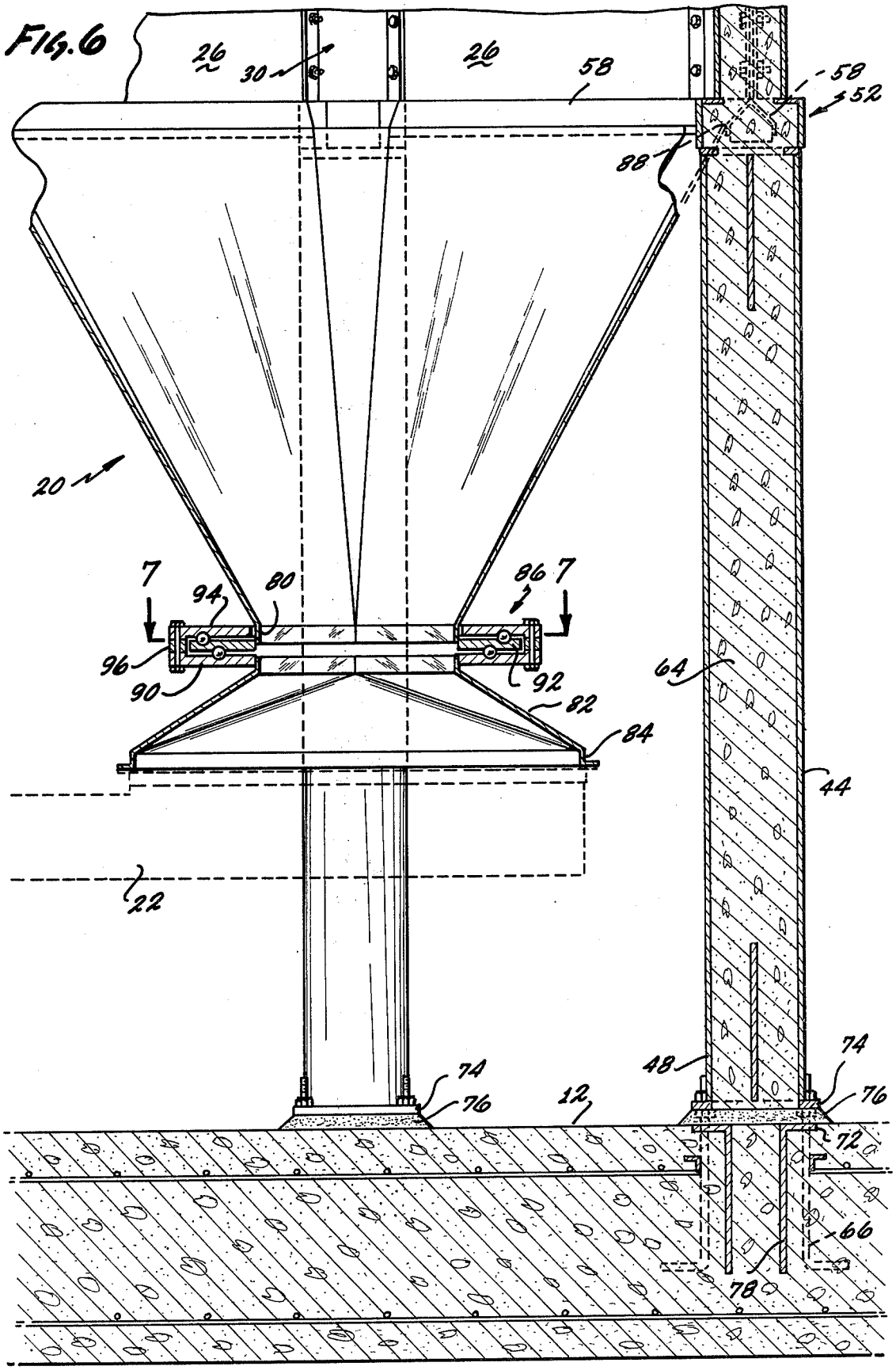
FIG. 6 is a side cross-sectional view in the direction 6—6 shown in FIG. 5 and showing a hopper used in a preferred embodiment of the present invention.

As can be seen in cross-section in FIG. 6, in accordance with a preferred embodiment of the present invention, a column of concrete extends from the foundation 12 upward through the tube 44, through the hexagonal cap 52, and continues upward inside the triangular prismatic space defined by the connectors 30. This solid column of concrete provides great load-bearing capacity, which is highly advantageous considering that each of the working bins typically holds 60 tons of commodity. This solid column of concrete serves as a solid base on which relatively heavy machinery, such as the distribution system 18 of FIG. 1, can be mounted on top of the cluster of bins.

FIG. 6 also shows the cone-like hopper 20 which extends downwardly and inwardly from the lower edge of the hopper. The hopper includes a lower edge 80 defining an aperture through which the stored material passes as it is discharged from the working bin.

In a preferred embodiment, a negative pressure cone 82 is connected to the lower edge 80 of the hopper 20 for the purpose of reducing the downward pressure of the stored material on the mechanism of the feeder screw 22 which is attached by means of an adaptor 84 to the negative pressure cone 82. In a preferred embodiment of the invention, the negative pressure cone 82 is connected to the hopper 20 by a bearing 86 to permit the negative pressure cone 82 to rotate about a vertical axis with respect to the hopper 20 so that the direction of the feeder screw 22 can be selectively altered. The upper edge 88 of the hopper 20 is welded to the struts 58 which extend around the periphery of the working bin at its lower end 60.

Figure 7:
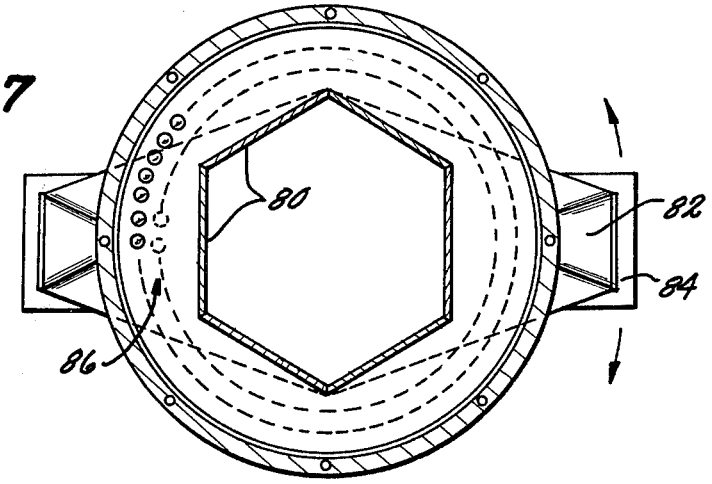
FIG. 7 is a top cross-sectional view in the direction 7—7 indicated in FIG. 6 and showing the negative pressure cone and its bearings.

FIG. 7 is a cross-sectional view showing the bearing 86 in the direction 7—7 of FIG. 6. The bearing 86 is designed to operate smoothly in spite of the tremendous weight of stored commodity which it supports. The bearing includes a lower annular plate 90 attached to the negative pressure cone 82, a flange 92 attached to the hopper 20, and an upper annular plate 94 spaced from the lower annular plate 90 and connected to it by a spacer 96.

Figure 8:
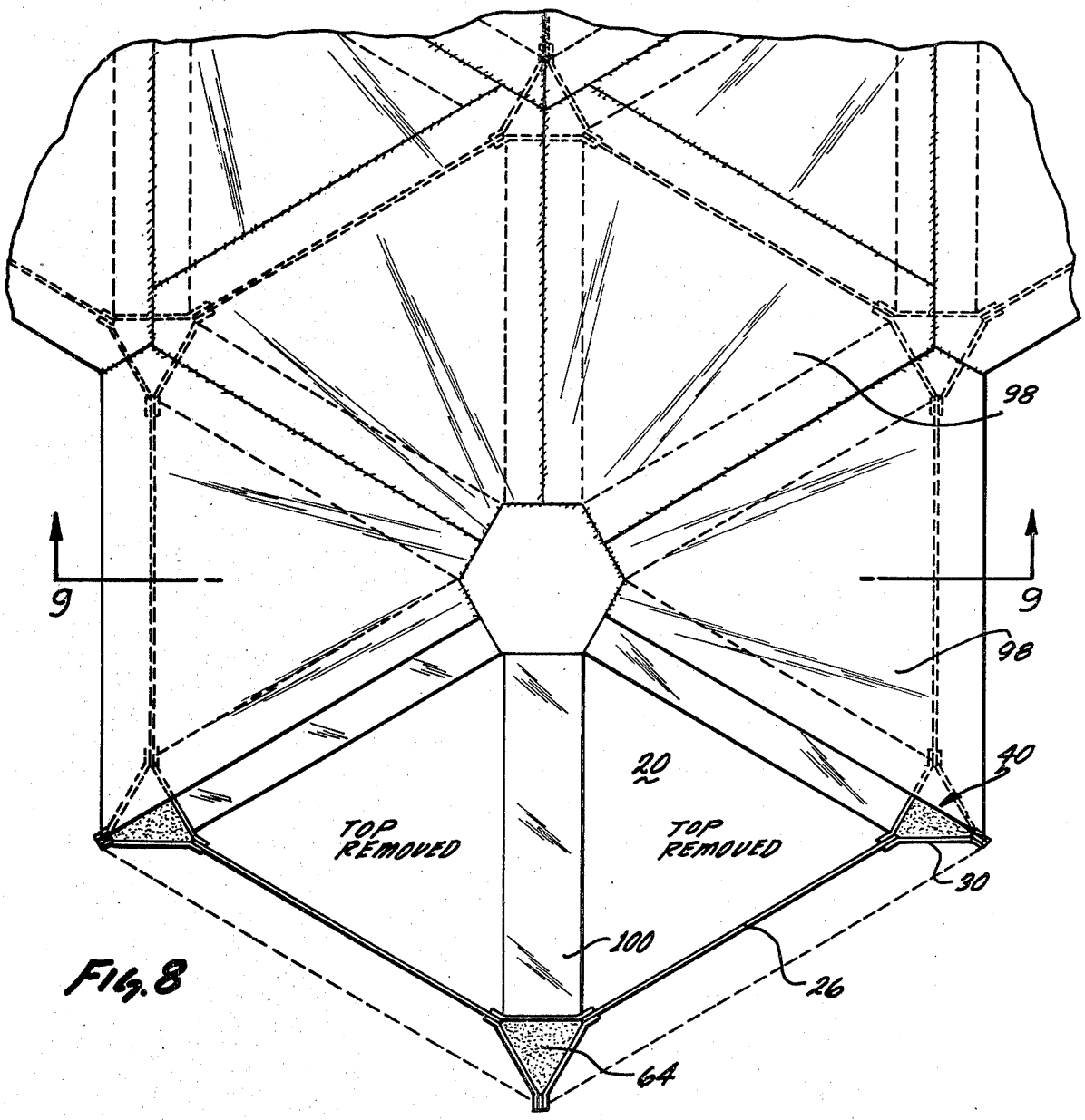
FIG. 8 is a top view of the cluster of working bins of FIGS. 1 and 2 and showing the structure of the roof used in a preferred embodiment.
Figure 9:
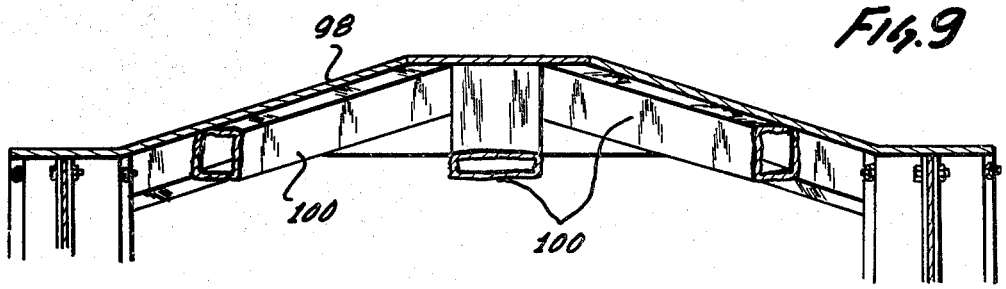
FIG. 9 is a side cross-sectional view in the direction 9—9 indicated in FIG. 8.

FIG. 8 is a fractional top view of the cluster of bins shown in FIG. 2. In FIG. 8 and FIG. 9 of the roof of the working bin is shown. In a preferred embodiment of the invention, the roof includes a number of panels 98 extending between and covering tubular rafters 100.

Figure 10:
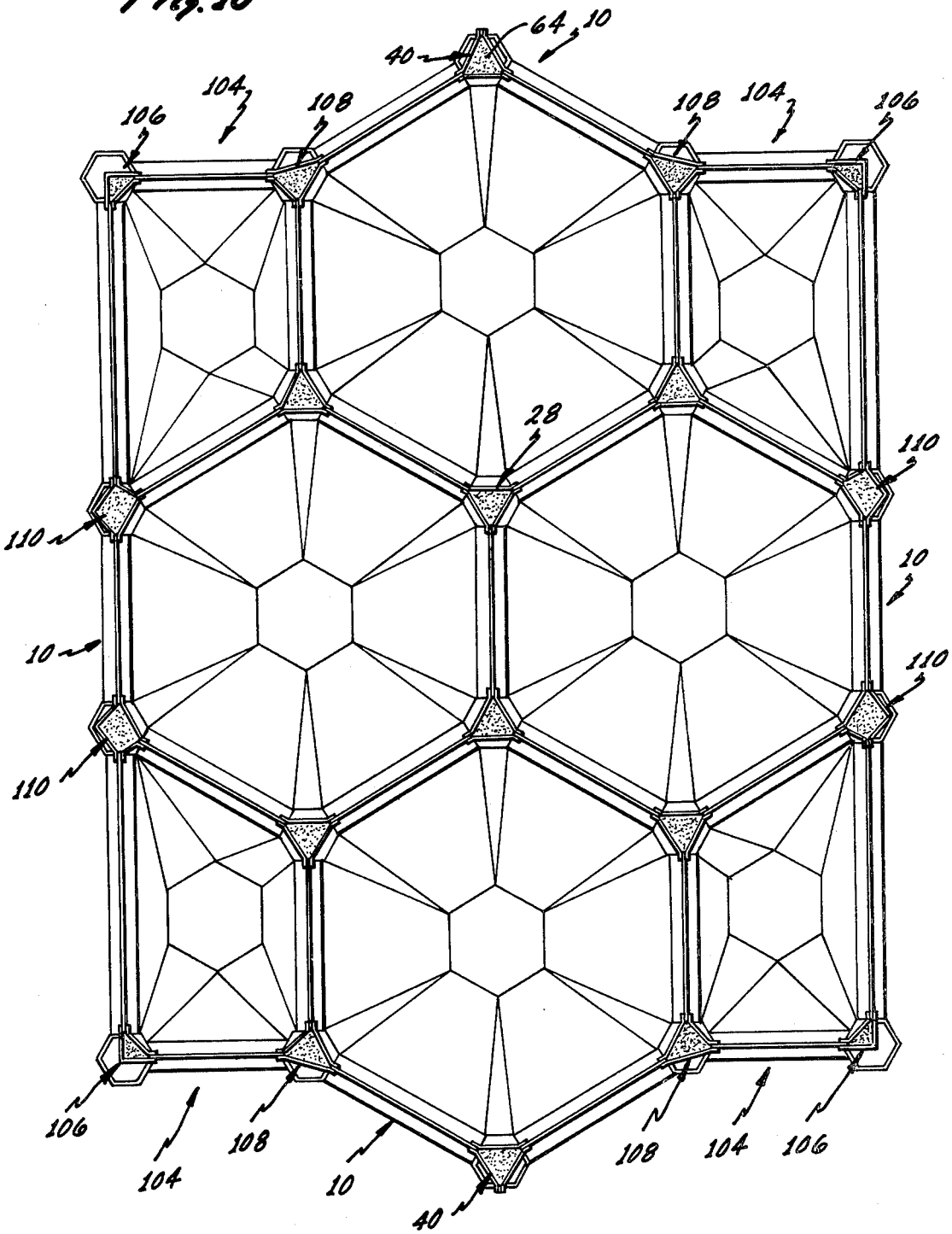
FIG. 10 is a cross-sectional view looking downward as in FIG. 2 but showing a cluster of working bins constructed in accordance with an alternative embodiment of the present invention.

FIG. 10 is a top cross-sectional view, similar to that of FIG. 2, but showing an alternative embodiment of a cluster of working bins of the present invention. In the alternative embodiment of FIG. 10, the basic cluster of working bins shown in FIG. 2 has been augmented by the addition of four smaller working bins at locations around the periphery of the original four working bins to form an enlarged cluster having twice as many working bins, having greater total storage capacity, having bins of larger and smaller size, and having a more nearly rectangular cross-section which has aesthetic appeal for some persons. The smaller bins 104 have approximatey one-third the storage capacity of the original hexagonal bins 10. It will be noted that in the smaller bins 104, the vertical walls do not intersect at 120 degrees, and further, that the smaller bins 104 have only four sides.

Figure 11:
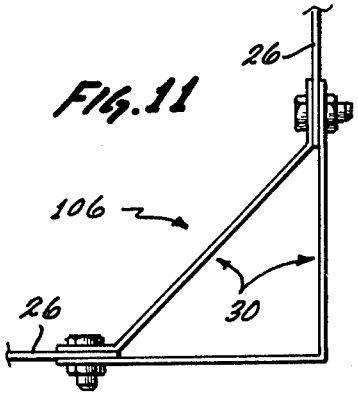
FIGS. 11–13 are fractional cross-sectional views looking downward as in FIG. 10 and showing with greater clarity some of the joints used in forming the structure of the alternative embodiment shown in FIG. 10.
Figure 12:
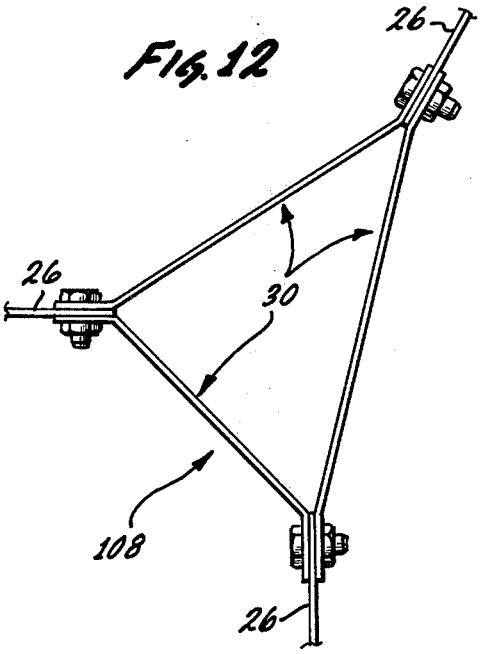
Figure 13:
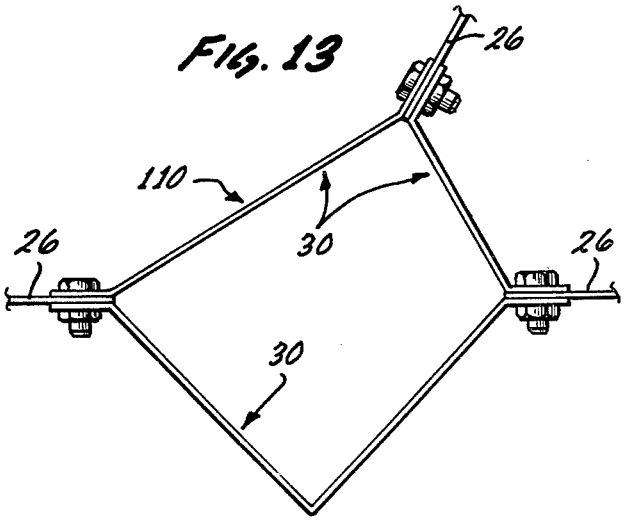

The irregular shape of the smaller bins 104 necessitates the use of the joints 106, 108, 110 which generally conform to the construction of the joint 28 shown in FIG. *3a,* but which differ from it in that some of the angles are different. The joints 106, 108, 110 are shown more clearly in FIGS. 11, 12, and 13, respectively. The most notable feature of the joints 106, 108, 110 is that in each case the connectors 30 define a vertically extending prismatic space which is filled with a castable material 64 after the working bins have been erected. This mode of construction imparts great rigidity and load-bearing ability to the structure and produces a water-tight seal between adjacent bins.

The types of working bins described above in connection with the preferred embodiment of the years 1, 2, and 3a, as well as the alternative embodiment of FIGS. 10–13 lends itself to a method of construction which is both rapid and economical. The following paragraphs will deal with the method used for erecting the cluster of working bins.

After the site has been prepared, the ground anchors 16 of FIGS. 1 and 5 are positioned at the corners of the working bins 10. Thereafter, concrete is poured around the ground anchors to form the foundation 12.

Thereafter, the tubes 44 of FIG. 5 are set in place and adjusted so that their axes are vertical and so that their tops all lie in a common substantially horizontal plane. After the tubes 44 have been thus adjusted, they too are filled with concrete in a preferred embodiment.

As may be seen most clearly in FIG. 5, after the tubes 44 have been filled with concrete, the top of each tube is closed by welding a circular plate onto the top of it. Next, the hexagonal caps 52 are set in place on top of the circular plates 50 and are rotated with respect to the axis of the column to positions in which the vertical faces of the caps on adjacent columns face opposite one another. At this point the vertical faces are aligned perpendicularly to imaginary lines connecting the axes of adjacent columns. The hexagonal caps 52 are then welded in place to the circular plates 50. If necessary, the columns can again be leveled so that the tops of the hexagonal cap lie in a common substantially horizontal plane. Thereafter, the horizontally extending struts 58 are bolted to the hollow hexagonal caps 52 and the diagonal cross-braces 24 are then installed between adjacent columns. The resulting structure of interconnected pillars 14 is shown in FIG. 14 to which reference will now be made.

Depending on the number of working bins to be included within the cluster, a number of working bins 10 are assembled on the ground at the construction site. Each of the hexagonal bins typically measures 45 feet long, 8 feet high between opposing sides, and ten feet between diametrically opposite corners. Assembly of the working bins on the ground results in a great savings in labor.

When the working bins are assembled on the ground, the three connectors 30 at each of the corners are included in the assembly as shown in FIG. 14. As will be seen, this facilitates assembly of the remaining bins. The number of working bins 10 assembled on the ground is equal to the number of hexagons in the structure having no side in common.

The working bins which have been assembled on the ground are hoisted into place by the sixty-ton crane 112. The crane 112 includes a 80 foot boom 114 and a 40 foot jib 116.

The crane is rigged as follows. The jib cable 118 is hooked to a choker cable 120 just outside of the upper end 122 of the working bin 10. The choker cable typically is approximately 25 feet long and one-half inch in diameter. To avoid placing too severe a stress on the working bin 10, a fixture 124 defining an aperture 126 through which the choker cable 120 passes is installed at the upper end 122 of the working bin 10. About midway along the length of the working bin 10, six choker cables 128 are joined to the end of the choker cable 120, and extend from it to the six corners at the lower end 130 of the working bin. These six cables serve to distribute the lifting force when the working bin has been hoisted to a vertical position suspended from the jib cable 118. Another choker cable 132 is connected at its ends to the uppermost two corners 134 of the bin lying on its side. The length of the choker cable 132 is approximately ten feet, and it forms a loop to which the main cable 136 is hooked.

Initially, the boom 114 is inclined at approximately 45 degrees. Both the jib cable 118 and the main cable 136 are taken up simultaneously to lift the working bin 10 off the ground in a horizontal attitude to a height of approximately ten feet above the ground. The hoisted bin is then rotated to a vertical attitude by keeping the main cable 136 fixed while taking up the jib cable 118 and raising the jib 116. As the working bin is brought to a vertical attitude, the jib cable 118 supports an ever-increasing fraction of the weight of the working bin, until, when the bin has been rotated to a vertical attitude the entire weight is carried by the jib cable 118 and the main cable 136 is unhooked from the choker cable 132. Rotation of the working bin to the vertical attitude above the ground is preferable to simply tilting it to a vertical attitude while leaving its lower end 130 on the ground because in the latter method the weight of the bin is rested on its lower edge which bears against the ground, and as the bin is rotated, the connectors will be damaged. In the preferred embodiment of the method, rotation of the bin to a vertical attitude is accomplished with the entire bin supported above the ground. After the bin has been rotated to the vertical attitude, it is positioned by use of a crane 112 to a position directly above one of the hexagons formed by the struts 58 and with the corners of the bin directly above the pillars 14. The bin is then lowered into contact with the pillars by letting out the jib cable 118. As soon as tension is relieved on the jib cable 118, the cables 128 are released from the lower end 130 and drawn upwardly through the aperture 126 by taking in the jib cable 118. Next, the lower edges 60 of the bin walls are welded to the struts 58. Thereafter, the remaining hexagonal-shaped working bins that have been formed on the ground have been similarly hoisted into their desired positions.

At this stage, the cluster of working bins still lacks a number of the vertical walls 26. In some instances the missing vertical walls are adjacent one another, while in other instances, an isolated wall is required. Pairs of walls 26 are assembled on the ground as shown in FIG. 15. The assembled pairs of walls form a structure which is not as strong as the hexagonal structure of the working bin 10, and, therefore, it is necessary to provide spreader bars 138 at each end of the structure to give it added rigidity. The spreader bar 138 at the upper end 140 of the pair of walls includes a hoop 142 through which the jib cable passes. The jib cable 118 is attached to the pair of walls at their lower end 144.

The main cable 136 is hooked to a free-slip pulley 146 through which a cable 148 runs freely. The cable 148 is attached to a pair of walls at two points 150, 152. The attachment at the point 152 includes a pull pin which can be pulled out when the cable 148 is slack to disengage the cable 148.

To avoid damage to the pair of walls, rotation of them to a vertical attitude is performed after the pair has been hoisted to a position above the ground. The hoisting and positioning of the pair of walls is quite similar to that described above in connection with the working bins. When the vertically-oriented pair of walls has been suspended in a position overlying a pair of adjacent struts, the suspended pair is attached to the previously erected prism-shaped working bins by fasteners.

After all of the pairs of bin walls have been erected, the structure forming the cluster of bins is completed by hoisting individual bin walls into the required positions and attaching them by fasteners to the previously erected bin walls. At this stage, all of the bin walls which remain unwelded to the underlying struts are welded to them. Thereafter, the upwardly-extending prismatic spaces defined between the connectors is filled with a castable material. Construction of the cluster of bins is completed by attaching the hoppers to the bins, the hoppers being welded to the struts at the lower periphery of the bins. Finally, a roof is attached to each of the bins.

It is now seen that the unique structure of the cluster of working bins permits the cluster to be constructed in a novel and highly advantageous manner, with most of the assembly work being performed on the ground rather than on elevated scaffolds.

The foregoing detailed description has illustrated a preferred embodiment and an alternative embodiment of the invention, but it is to be understood that still other embodiments will be obvious to those skilled in the art. The embodiments described herein together with those additional embodiments are considered to be within the scope of the invention.

What is claimed is:

1. A working bin in the form of a hollow prism whose cross section in a horizontal plane conforms generally to a hexagon, comprising:

six vertical walls of flat sheet metal, adjacent pairs of which converge laterally toward a corner of the hexagon but terminate at vertical edges short of the corner;

six connectors of identical shape, each formed of flat sheet metal and associated with a different adjacent pair of said six vertical walls;

each connector having a central panel extending between the edges of its associated pair of adjacent walls, said central panel flanked by planar side panels lying flush against and attached to those surfaces of the pair of adjacent walls which face toward the interior of the hexagon;

six pillars for supporting the hollow prism at the corners of the hexagon, each pillar including a ground anchor extending into a foundation;

a column connected at its lower end to said ground anchor and having a central axis passing vertically through a corner of the hexagon;

a cap connected to said column at its top, having six vertical faces forming a hexagonal prism, said faces oriented perpendicular to the directions of the adjacent vertical walls which are joined at said corner, each of said connectors resting on top of one of said caps and attached to it, said working bin further comprising six struts, each extending horizontally and connecting opposing vertical faces of the caps on adjacent columns around the periphery of the working bin and supporting said vertical walls, each of said vertical walls terminating in a lower edge which rests on and is attached to one of said six struts.

2. The working bin of claim 1 wherein each of said vertical walls is welded along its lower edge to one of said six struts.

3. The working bin of claim 1 wherein said column is a hollow metal cylinder filled with a solidified castable material.

4. The working bin of claim 1 wherein each of said caps is connected to a column by a circular plate covering the top of the column.

5. The working bin of claim 1 wherein said caps are hollow.

6. The working bin of claim 1 wherein said struts are bolted at their ends to said opposing vertical faces of the caps.

7. The working bin of claim 1 further comprising a hopper attached to said six struts, tapering inwardly downwardly from them, and including a lower edge defining an aperture.

8. The working bin of claim 1 wherein the vertical walls extend upwardly to top edges lying in a common substantially horizontal plane, said working bin further comprising a roof connected to said vertical walls and disposed above them to cover the space included between them.

9. The working bin of claim 1 wherein said column further comprises a flange attached to its lower end, extending horizontally, and including clearance holes extending vertically through it; and wherein said ground anchor further comprises anchor bolts extending vertically upward from said foundation, passing through said clearance holes and connecting said column to said ground anchor.

10. The working bin of claim 1 wherein said ground anchor further comprises:

several anchor bolts engaging said foundation and having shanks extending vertically at positions around the outside of said column;

a frame connecting the shanks of said several anchor bolts;

a plate oriented substantially horizontally, having clearance holes adjacent its edge for passing said anchor bolts, and having a central aperture, said plate positioned on said anchor bolts above said frame; and, a tube extending vertically downward from said central aperture into said foundation in the space between the anchor bolts.

11. The working bin of claim 10 wherein said tube is filled with a solidified castable material.

12. A cluster of working bins in the form of a honeycomb structure comprising:

three vertical walls of flat sheet metal coverging toward a common line of intersection but terminating at edges short of it and parallel to it;

three connectors of identical shape, each formed of flat sheet metal and associated with a different pair of said three planar walls;

each connector having a central panel extending between the edges of its associated pair of planar walls, said central panel flanked by planar side panels lying flush against and attached to those surfaces of the pair of planar walls which face away from the third planar wall, said three connectors defining a prismatic space enclosed by said central panels, said three planar walls extending outwardly from the corners of said space away from their common line of intersection;

a pillar for supporting said three connectors, said pillar including a ground anchor extending into a foundation;

a column connected at its lower end to said ground anchor and having a vertical central axis coincident with said common line of intersection;

a cap connected to said column at its top, having six vertical faces forming a hexagonal prism, said faces oriented perpendicular to the directions of said three planar walls which are joined by said three connectors, each of said three connectors resting on top of said cap and attached to it, said working bin further comprising three struts, each extending horizontally from one of the vertical faces of the cap and supporting said planar walls, each of said planar walls terminating in a lower edge which rests on and is attached to one of said three struts.

13. The cluster of working bins of claim 12 wherein each of said three planar walls is welded along its lower edge to one of said three struts.

14. The cluster of working bins of claim 12 wherein said column is a hollow metal cylinder filled with a solidified castable material.

15. The cluster of working bins of claim 12 wherein said cap is connected to said column by a circular plate covering the top of the column.

16. The cluster of working bins of claim 12 wherein said cap is hollow.

17. The cluster of working bins of claim 12 wherein said struts are bolted at their ends to said vertical faces of the cap.

18. The cluster of working bins of claim 12 further comprising a hopper attached to one of said three struts, extending downwardly from it, and including a lower edge defining an aperture.

19. The cluster of working bins of claim 12 wherein said planar walls extend upwardly to top edges lying in a common substantially horizontal plane, said working bin further comprising a roof connected to said planar walls and disposed to cover said top edges.

20. The cluster of working bins of claim 12 wherein said column further comprises a flange attached to its lower end, extending horizontally, and including clearance holes extending vertically through it;

and wherein said ground anchor further comprises anchor bolts extending vertically upward from said foundation, passing through said clearance holes and connecting said column to said ground anchor.

21. The cluster of working bins of claim 12 wherein said ground anchor further comprises:

several anchor bolts engaging said foundation and having shanks extending vertically at positions around the outside of said column;

a frame connecting the shanks of said several anchor bolts;

a plate oriented substantially horizontally, having clearance holes adjacent its edge for passing said anchor bolts, and having a central aperture, said plate positioned on said anchor bolts above said frame; and, a tube extending vertically downward from said central aperture into said foundation in the space between the anchor bolts.

22. The cluster of working bins of claim 12 wherein said tube is filled with a solidified castable material.

23. In a working bin of the type in which a prismatic chamber having a horizontal cross section shaped like a hexagon is supported on pillars, the improvement comprising:

hollow vertical columns attached at their lower ends to ground anchors embedded in a foundation at the corners of the hexagon, filled with concrete, and serving as pillars to support the prismatic chamber;

a hexagonal cap connected to each column at its top with faces of the hexagonal cap aligned perpendicularly to lines connecting adjacent columns; and, horizontally-extending struts connected between the opposing faces of the hexagonal caps of adjacent columns, the uppermost surfaces of said hexagonal caps and of said horizontally-extending struts lying in a common substantially horizontal plane and supporting the prismatic chamber.

24. A method of constructing a cluster of working bins shaped like hexagons and arranged in a honeycomb pattern on a site, comprising the steps of:

(a) attaching hollow vertical columns to ground anchors embedded in a foundation at the corners of the hexagons;

(b) filling each column with a castable material;

(c) connecting a hexagonal cap to each column at its top, with faces of the hexagonal cap aligned perpendicularly to lines connecting adjacent columns; and, (d) connecting horizontally-extending struts between the opposing faces of the hexagonal caps of adjacent columns with the uppermost surfaces of said hexagonal caps and of said horizontally-extending struts lying in a common substantially horizontal plane and supporting the bins.

* * * * *